United States Patent [19]

Adachi et al.

[11] Patent Number: 4,496,631

[45] Date of Patent: Jan. 29, 1985

[54] ACRYLIC FIBERS FOR PRODUCING CARBON FIBERS

[75] Inventors: Yasuo Adachi, Ehime; Kiyoyuki Nabae, Iyo, both of Japan

[73] Assignee: Toray Industries, Inc., Tokyo, Japan

[21] Appl. No.: 498,290

[22] Filed: May 26, 1983

[30] Foreign Application Priority Data

May 26, 1982 [JP] Japan ..... 57-88210

[51] Int. Cl.[3] ..... D02G 3/00

[52] U.S. Cl. ..... 428/394; 8/115.6; 264/29.2; 423/447.1; 423/447.2; 423/447.4; 428/367

[58] Field of Search ..... 428/375, 394, 367; 8/115.6; 427/387, 385.5; 264/29.2; 423/447.1, 447.2, 447.4

[56] References Cited

U.S. PATENT DOCUMENTS

| | | | |
|---|---|---|---|
| 2,976,186 | 3/1961 | Thompson et al. | 428/394 X |
| 4,004,053 | 1/1977 | Gump et al. | 428/394 X |
| 4,080,417 | 3/1978 | Kishimoto et al. | 427/387 X |
| 4,246,423 | 1/1981 | Martin | 427/387 X |
| 4,259,307 | 3/1981 | Maruyama | 264/29.2 X |

*Primary Examiner*—Lorraine T. Kendell

*Attorney, Agent, or Firm*—Armstrong, Nikaido, Marmelstein & Kubovcik

[57] ABSTRACT

Disclosed are acrylic fibers for producing carbon fibers having deposited thereon an aqueous oil composition. The aqueous oil composition contains an oil component an organic anti-oxidant, and a linear-chain organo silicone as necessary components.

6 Claims, No Drawings

ACRYLIC FIBERS FOR PRODUCING CARBON FIBERS

BACKGROUND

This invention relates to acrylic fibers for producing carbon fibers.

Carbon fibers are produced and used on a large scale as reinforcing fibers for composite materials to be used in many fields including aircraft, spacecraft, pressure vessels to be placed on the sea bed, and sporting goods such as golf shafts, tennis rackets, and fishing rods due to their excellent physical and chemical properties.

As the raw fiber materials for producing such carbon fibers, or precursors, viscose fibers, acrylic fibers, and pitch fibers are typically employed. It is well known that these precursors are converted to carbon fibers generally through the process of oxidizing them in an oxidative atmosphere at 200° to 400° C. to render them flame-resistant or infusible and carbonizing the thus oxidized fibers in an inert atmosphere at elevated temperatures of at least 800° C.

The precursors to be rendered flame-resistant or infusible and then carbonized or graphitized under the above-described severe conditions can cause, in the heat treatment at elevated temperatures, particularly in the step of rendering the precursors flame-resistant or infusible, an adhering or sticking phenomenon (hereinafter referred to simply as adhering) between fibers and fluffing or breaking of fibers resulting from generation of mechanical defects of fiber surfaces. Thus, it is not necessarily easy to produce carbon fibers having definite quality and performance with good productivity.

That is, precursor fibers for producing carbon fibers, which are to be converted to oxidized fibers in the oxidation step of rendering them flame-resistant or infusible through complicated chemical reactions such as intermolecular crosslinking or intramolecular cyclization, suffer softening, partial adhering, and tar formation with the progress of the reactions in the above-described step, unavoidably leading to adhering between fibers and easy formation of fiber defects. The adhering between fibers and generation of fiber defects to be caused by the treatment of rendering the precursor fibers flame-resistant greatly depend upon the kind of oil composition deposited thereon. Oil compositions with a low heat resistant fail to prevent the adhering phenomenon and generation of fiber defects, and exert detrimental influences on the precursor fibers.

For removing the above-described troubles or problems with the production of carbon fibers, many proposals have been made on the composition of raw materials constituting precursor fibers (polymer composition, pitch composition, etc.) and on the treatment thereof with chemicals or oils. A proper oil composition for the precursor must be selected taking into consideration not only the troubles or problems encountered in the step of converting the precursor into carbon fibers but other factors as well. The oil composition to be deposited onto the precursor directly influences productivity, process stability, quality, performance, etc. of the precursor itself.

For example, silicone oils are known to be effective for preventing adhering between fibers in the aforesaid oxidation step for the production of carbon fibers using acrylic fibers as precursor fibers, and many silicone oils have been proposed, for example, in Japanese Patent Application (OPI) Nos. 103313/80 and 122021/80, and U.S. Pat. No. 4,259,307.

However, although these silicone oils reduce, to some extent, the adhering phenomenon between fibers in the oxidation step of converting them to oxidized fibers, acrylic fibers having been treated with the silicone oil are liable to generate static electricity, and fluffing, winding round rollers and guides, and breaking of fibers, etc. occurs thus rendering the process operation unstable.

SUMMARY

As a result of intensive investigations to find an oil composition which does not cause fluffing and breaking of precursor fibers and adhering phenomenon between single fibers and which enables carbon fibers with high quality and high performance to be produced, the inventors have achieved the present invention.

That is, an object of the present invention is to provide precursor fibers for producing carbon fibers without causing the troubles of fluffing and breaking of precursor fibers by selecting a proper oil composition to be used in the process of producing carbon fibers.

Another object of the present invention is to provide precursor fibers which do not undergo adhering of single fibers in the oxidation step of converting the precursor fibers to oxidized fibers or in the step of carbonizing them.

A further object of the present invention is to provide acrylic fibers for producing carbon fibers which have improved density and, therefore, are converted to carbon fibers with high strength.

These objects of the present invention can be attained by acrylic fibers for producing carbon fibers, which have deposited thereon an oil composition comprising a compound of a higher alcohol containing at least 18 carbon atoms and/or a compound of a higher fatty acid containing at least 18 carbon atoms, an organic anti-oxidant, and a linear-chain organo silicone.

DESCRIPTION

In the oil composition comprising a higher alcohol compound and/or a higher fatty acid compound, an organic anti-oxidant, and a linear-chain organo silicone to be used in the present invention, the organic anti-oxidant has the effect of improving heat resistance of the higher alcohol compound and/or the higher fatty acid compound. Compounding of the silicone in addition to the anti-oxidant does not spoil the performance of the oil composition, and exerts the synergistic effect of allowing the oil composition to function as a process oil and prevents adhering or sticking between single fibers in the oxidation step of converting them to oxidized fibers.

As to the higher alcohol compound and/or the higher fatty acid compound which are constituents of the oil composition to be used in the present invention, if the higher alcohol and the higher fatty acid contains less than 18 carbon atoms, the oil composition permeates into precursor fibers so much that the adhering-preventing effect is decreased, which can sometimes cause deterioration of physical properties, particularly cause defects of carbon fibers. Therefore, as the higher alcohol compound and/or the higher fatty acid compound those in which the higher alcohol and fatty acid contain at least 18, preferably 18 to 25, carbon atoms are used.

Examples of the higher alcohol compound include phosphate of stearyl alcohol and ethylene oxide adducts

[$(EO)_n$] of stearyl alcohol, oleyl alcohol, behenyl alcohol or isopentacosanyl alcohol (n: about 20 to about 40). Of these, ethylene oxide adducts [$(EO)_n$] of stearyl alcohol, oleyl alcohol, behenyl alcohol, isopentacosanyl alcohol, etc. are preferably used. These compounds may be used as a mixture of two or more of them.

As the higher fatty acid compound, there may be used, for example, stearic acid glyceride and polyethylene glycol (PEG) stearate, PEG oleate, PEG sorbitan oleate, PEG sorbitan stearate, etc., with PEG stearate and PEG oleate being preferably used. The PEG moiety described above has a molecular weight of 400 to 1,000. These compounds may be used in combination of two or more of them.

The organic anti-oxidant to be used in combination with the higher alcohol compound and the higher fatty acid compound is required to be compatible with these compounds, to give precursor fibers resistance against initial heating for converting the precursor fibers to oxidized fibers by raising the heat resistance of the compound of the alcohol and the fatty acid, and to be easily pyrolyzed into volatiles which immediately escape with leaving no pyrolysis residue on the precursor fibers.

As such anti-oxidant, 4,4'-butylidene-bis(3-methyl-6-tert-butylphenol), 4,4'-thio-bis(3-methyl-6-tert-butylphenol), bis(2,2,6,6-tetramethyl-4-piperidine) sebacate, tetrakis [methylene-3(3,5-di-tert-butyl-4-hydroxyphenyl)-propionato]methane, di(nonylphenyl)dinonylphenyl phosphite, etc. are preferably used. These compounds may be used in combination of two or more of them.

The anti-oxidant is compounded in an amount of 1 to 20 wt % per 80 to 99 wt % of the higher alcohol compound and/or higher fatty acid compound. If the amount is less than 1%, insufficient heat-resisting effects result, whereas if more than 20%, the antioxidant can remain as a pyrolysis residue on the resulting flame-resistant or infusible oxidized fibers or on carbonized or graphitized fibers, thus such amounts being unfavorable.

The linear-chain organo silicone to be compounded in the oil composition in accordance with the present invention must be compatible with the higher alcohol compound and/or higher fatty acid compound, and organo silicone substances having some water dispersibility are used. Specific examples thereof include polyether-modified polysiloxane, alcohol-modified polysiloxane, dimethylpolysiloxane having been emulsion-polymerized in the presence of some emulsifier, alkyl-modified polysiloxane, amino-modified polysiloxane, etc.

Preferable organo silicones are polyether-modified polysiloxanes having an oil viscosity (25° C.) of 50 to 3,000 centistokes and having a glycol-to-oil compounding ratio of 50 to 70 wt %.

This linear-chain organo silicone is compounded with the higher alcohol compound and/or the higher fatty acid compound and the organic anti-oxidant in an amount ranging from 5 to 50 wt % per 50 to 95 wt % of the higher alcohol compound and the higher fatty acid compound and the organic anti-oxidant. If the amount is less than 5 wt %, the effect of the present invention of providing high performance carbon fibers not undergoing adhering is not fully exerted, whereas if the amount is more than 50 wt %, the effects of preventing generation of static electricity by the higher alcohol compound and/or the higher fatty acid compound to be used together with the organo silicone, preventing fluffing, and improving bundling properties become insufficient, thus such amounts being unfavorable.

The oil composition can be prepared according to various known methods. For example, where a solid higher alcohol compound or a solid higher fatty acid compound is used, it is heated to 40° to 70° C. to cause it to melt, then an anti-oxidant is added thereto under stirring. The resulting oil compound is then added to about 40° to 70° C. water under stirring, followed by adding thereto the organo silicone under stirring to prepare an intended oil solution. This oil solution is applied to precursor fibers in a conventional manner. The amount of the oil composition to be deposited ranges from about 0.5 to about 3% based on the weight of the fibers. However, the deposition amount is not limited and varies depending upon the kind of the higher alcohol compound and higher fatty acid compound and the kind of silicone.

The oil composition of the present invention comprises the aforesaid higher alcohol compound and/or the higher fatty acid compound, the organic anti-oxidant, and the linear-chain organo silicone. Synergistic effects can be obtained by uniformly compounding these ingredients.

The oil composition has the same solution stability and the same properties of uniformly depositing onto the precursor fibers as the straight-chain silicone does.

Carbon fibers obtained by depositing the oil composition on the precursor fibers and subsequent heat treatment do not undergo adhering, fluffing, and breaking of fibers and possess high strength with less unevenness in strength. In producing composite materials using the resulting carbon fibers, ordinary processing conditions can be employed.

The oil composition to be used in the present invention shows excellent performance as a process oil in producing acrylic fibers to be used for producing carbon fibers, prevents fluffing and breaking of fibers in the step of rendering the precursor fibers flame-resistant or infusible, and prevents fibers from adhering to each other in the step of rendering the precursor fibers flame-resistant or infusible or in the step of carbonization, thus enabling the production of carbon fibers with high productivity.

In addition, the acrylic fibers of the present invention provide carbon fibers having high strength, and the resulting carbon fibers can be suitably used for producing composite materials.

The present invention will now be described in more detail by reference to the following examples.

EXAMPLE 1 & COMPARATIVE EXAMPLE 1

99.0 mol % of acrylonitrile, 0.5 mol % of sodium allylsulfonate, and 0.5 mol % of 2-hydroxyethylacrylonitrile were polymerized according to a solution polymerization process using dimethylsulfoxide as a solvent, and a 22% spinning solution of the resulting polymer was spun into a dimethylsulfoxide aqueous solution, then washed and stretched in a known manner to obtain stretched tows of 3,000 deniers and 3,000 filaments.

These stretched tows were dipped in a 5% solution of a mixture containing stearyl alcohol $EO_{20}$ (which means an adduct of 20 mols of ethylene oxide), di(nonylphenyl)-dinonylphenyl phosphite, and polyether-modified polysiloxane [polydimethylpolysiloxane EO adduct; 100 centistokes (25° C.)] in proportions given in Table 1, then dried at 150° C. to obtain 6.5 g/d precursor fibers.

Each precursor had deposited thereon the oil composition in an amount of 1.7 to 2.3% based on the weight of the precursor.

These precursors were fed to an oxidation step of rendering them flame-resistant via guides and rollers.

Generation of static electricity, formation of fluffs, and bundling properties during the period from production of the precursor to the oxidation step, are shown in Table 1.

As is clear from Table 1, no electrostatic troubles occurred and good process operation was realized only when the silicone was compounded in an amount of 50% or less.

TABLE 1

| | No. | Stearyl Alcohol $EO_{20}$ | Di(nonyl-phenyl)-dinonyl-phenyl Phosphite | Polydi-methyl-poly-siloxane EO Adduct | Generation of Static Electricity | Process Operation |
|---|---|---|---|---|---|---|
| Example 1 | 1 | 85% | 5% | 10% | not generated | good |
| | 2 | 75% | 5% | 20% | not generated | good |
| | 3 | 70% | 10% | 20% | not generated | good |
| | 4 | 45% | 5% | 50% | slightly generated | good |
| Comparative Example 1 | 5 | 35% | 5% | 60% | considerably generated | not good |
| | 6 | — | — | 100% | seriously generated | seriously bad |
| | 7 | 100% | — | — | not generated | good |
| | 8 | 90% | 10% | — | not generated | good |

In the above table, the compounding proportions of the higher alcohol compound and/or the higher fatty acid compound, anti-oxidant, and linear-chain organo silicone are presented as percents by weight.

EXAMPLE 2 AND COMPARATIVE EXAMPLE 2

The precursors obtained in Example 1 and comparative Example 1 were continuously subjected to the oxidation step and the carbonization step at a fiber speed of 3 m/min.

In the flame resistance-imparting step, they were treated in the air at 250° C. for 30 minutes and, in the carbonization step, they were passed through a 1,200° C. carbonizing furnace in a nitrogen atmosphere.

Adhering properties and strength of the resulting carbonized fibers are shown in Table 2.

TABLE 2

| | No. | Stearyl Alcohol $EO_{20}$ | Di(nonyl-phenyl)-dinonyl-phenyl Phosphite | Polydi-methyl-poly-siloxane EO Adduct | Adhering of Carbonized Fibers | Strength of Carbonized Fibers (kg) |
|---|---|---|---|---|---|---|
| Example 2 | 1 | 85% | 5% | 10% | no | 19.4 |
| | 2 | 75% | 5% | 20% | no | 20.1 |
| | 3 | 70% | 10% | 20% | no | 20.2 |
| | 4 | 45% | 5% | 50% | no | 20.3 |
| Comparative Example 2 | 5 | 35% | 5% | 60% | no | 18.0 |
| | 6 | — | — | 100% | no | 15.5 |
| | 7 | 100% | — | — | much | 10.5 |
| | 8 | 90% | 10% | — | slight | 16.4 |

In the above table, the compounding properties of the higher alcohol compound and/or the higher fatty acid compound, anti-oxidant, and linear-chain organo silicone are presented as percents by weight.

EXAMPLE 3

Oil compositions were deposited on the stretched fibers obtained in Example 1 in the same manner as in Example 1 except for changing the kind and compounding ratios of the higher alcohol compound and/or the higher fatty acid compound, organic anti-oxidant, and linear-chain silicone.

The amount of the deposited oil composition fell within the range of from 1.8 to 2.2% based on the weight of the precursor.

The thus treated fibers were subjected to the same baking treatment to obtain carbonized fibers. Generation of static electricity upon production of the precursor, fluffing, and bundling properties and physical properties of the carbonized fibers are shown in Table 3.

With every precursor, process operation was conducted smoothly, with the adhering phenomenon being greatly suppressed, and the resulting carbon fibers had excellent physical properties.

Additionally, silicones A and B given in the following table are as follows:

A: Ethylene oxide propylene oxide adduct of polydimethylpolysiloxane; 300 centistokes (25° C.);

B: Ethylene oxide adduct of polydimethylpolysiloxane; 600 centistokes (25° C.).

TABLE 3

| No. | Oil Ingredient | Anti-oxidant | Linear-chain Silicone | Generation of Static Electricity | Process Operation | Adhering of Carbonized Fibers | Strength of Carbonized Fibers (kg) |
|---|---|---|---|---|---|---|---|
| 1 | Oleyl alcohol $EO_{30}$ (62%) | Di(nonylphenyl) diphenyl phosphite (8%) | A (30%) | not generated | good | no | 19.6 |
| 2 | Stearyl alcohol $EO_{20}$ (50%) $PEG_{400}$ monooleate (16%) | 4,4'-Butylidene-bis(3-methyl-6-tert-butylphenol) (4%) | A (30%) | not generated | good | no | 20.1 |
| 3 | $PEG_{1000}$ monostearate (80%) | Di(nonylphenyl)-diphenyl phosphite (10%) | B (10%) | not generated | good | no | 19.2 |
| 4 | Oleyl alcohol $EO_{30}$ (60%) $PEG_{1000}$ monostearate (15%) | 4,4'-Thio-bis-(3-methyl-6-tert-butylphenol) (5%) | B (20%) | not generated | good | no | 20.2 |
| 5 | Behenyl alcohol $EO_{40}$ (50%) | Tetrakis-[methylene-3-(3,5-di-tert-butyl-4-hydroxyphenyl)propionato]-methane (10%) | A (40%) | not generated | good | no | 20.0 |
| 6 | Isopentacosanyl alcohol $EO_{40}$ (86%) | 4,4'-Butylidene-bis(3-methyl-6-tert-butylphenol) (4%) | B (10%) | not generated | good | no | 19.2 |

We claim:

1. Acrylic fibers for producing carbon fiber, which have deposited thereon an aqueous oil composition comprising at least one compound selected from the group consisting of phosphate of stearyl alcohol, ethylene oxide adduct of stearyl alcohol containing about 20 to about 40 mols of ethylene oxide, ethylene oxide adduct of oleyl alcohol containing about 20 to about 40 mols of ethylene oxide, ethylene oxide adduct of behenyl alcohol containing about 20 to about 40 mols of ethylene oxide, ethylene oxide adduct of isopentacosanyl alcohol containing about 20 to about 40 mols of ethylene oxide, stearyl glyceride and stearic, oleic or sorbitan-oleic ester of polyalkylene ether glycol having a molecular weight of about 400 to about 1,000; an organic anti-oxidant; and a linear-chain organo silicone, as necessary ingredients.

2. The acrylic fibers for producing carbon fibers as described in claim 1, wherein said organic antioxidant is at least one member selected from the group consisting of 4,4'-butylidene-bis(3-methyl-6-tert-butylphenol), 4,4'-thio-bis(3-methyl-6-tert-butylphenol), bis(2,2,6,6-tetramethyl-4-piperidine) sebacate, tetrakis [methylene-3-(3,5-di-tert-butyl-4-hydroxyphenyl)propionato] methane, and di(nonylphenyl)dinonylphenyl phosphite.

3. The acrylic fibers for producing carbon fibers as described in claim 1, wherein said linear-chain organo silicone is at least one member selected from the group consisting of polyether-modified polysiloxane, amino-modified polysiloxane, and alkyl-modified polysiloxane.

4. The acrylic fibers for producing carbon fibers as described in any one of claims 2, 3 or 1, wherein said oil composition is prepared by compounding 1 to 20 wt % of said organic anti-oxidant per 80 to 99 wt % of said at least one compound and further compounding in the resulting mixture 5 to 50 wt % of said linear-chain organo silicone per 50 to 95 wt % of said mixture.

5. The acrylic fibers for producing carbon fibers as described in claim 1, wherein said aqueous oil composition deposits on the fibers in an amount of about 0.5 to 3 wt % based on the weight of the fibers.

6. The acrylic fibers for producing carbon fibers as described in claim 1, wherein the acrylic fibers are bundles of 500 to 30,000 filaments having a single filaments fineness of 0.5 to 1.5 deniers.

* * * * *

UNITED STATES PATENT AND TRADEMARK OFFICE

CERTIFICATE OF CORRECTION

PATENT NO. : 4,496,631

DATED : January 29, 1985

INVENTOR(S) : YASUO ADACHI ET AL

It is certified that error appears in the above-identified patent and that said Letters Patent is hereby corrected as shown below:

On the cover page, Item [30], change "57-88210" to --- 57-88120 ---.

Signed and Sealed this

*Twenty-ninth* Day of *October 1985*

[SEAL]

*Attest:*

*Attesting Officer*

DONALD J. QUIGG

*Commissioner of Patents and Trademarks—Designate*